US005351461A

United States Patent [19]

Fandard et al.

[11] Patent Number: 5,351,461

[45] Date of Patent: Oct. 4, 1994

[54] INSTALLATION FOR PACKAGING A PALLETIZABLE LOAD

[75] Inventors: Philippe Fandard, Lyons; Georges Jaconelli, Brison-Saint-Innocent, both of France

[73] Assignee: Newtec International, Viroflay, France

[21] Appl. No.: 943,302

[22] Filed: Sep. 10, 1992

[30] Foreign Application Priority Data

Sep. 17, 1991 [FR] France ..... 91 11704

[51] Int. Cl.[5] ..... B65B 11/04; B65B 35/54

[52] U.S. Cl. ..... 53/157; 53/556; 53/587

[58] Field of Search ..... 53/157, 399, 441, 445, 53/588, 556, 587, 447, 540

[56] References Cited

U.S. PATENT DOCUMENTS

| | | | |
|---|---|---|---|
| 2,026,282 | 12/1935 | Leguillon | 53/399 X |
| 2,635,965 | 4/1953 | Hensgen et al. | 53/445 X |
| 2,716,315 | 8/1955 | Jacoby | 53/587 |
| 4,281,500 | 8/1981 | Mueller et al. | 53/587 X |
| 4,450,668 | 5/1984 | Grossi | 53/556 X |
| 4,458,467 | 7/1984 | Shulman et al. | 53/556 X |
| 4,607,476 | 8/1986 | Fulton | 53/587 X |
| 4,619,102 | 10/1986 | Geisinger | 53/587 X |
| 4,941,374 | 7/1990 | Focke | 53/157 X |
| 5,085,030 | 2/1992 | Segawa et al. | 53/441 X |
| 5,155,970 | 10/1992 | Moore | 53/556 X |
| 5,163,264 | 11/1992 | Hannen . | |
| 5,184,449 | 2/1993 | Hannen . | |

FOREIGN PATENT DOCUMENTS

| | | |
|---|---|---|
| 1017523 | 10/1957 | Fed. Rep. of Germany . |
| 1949047 | 4/1970 | Fed. Rep. of Germany . |
| 2628391 | 9/1989 | France . |

*Primary Examiner*—Linda B. Johnson

*Attorney, Agent, or Firm*—Bell, Seltzer, Park & Gibson

[57] ABSTRACT

Method and installation for packaging a palletizable load (20), in which the constituent elements (21) of the load (20) are positioned on the pallet in several levels or layers of palletization by a palletization member, wherein :

a sheet (9) of a material having non-slip properties is inserted between each level of palletization; and the peripheral strapping of the load is carried out by a microcreped stretchable paper tape.

5 Claims, 4 Drawing Sheets

INSTALLATION FOR PACKAGING A PALLETIZABLE LOAD

FIELD AND BACKGROUND OF THE INVENTION

The invention relates to an improved method for packaging a palletizable load, and in particular a method for automatically loading and strapping a load on a pallet. The invention also relates to the installation enabling the implementation of this method.

For a long time already, the transport of materials, both in bulk and in the form of primary packagings, such as packs, bottles, etc..., has been carried out by means of pallets on which the primary packagings are held by fixing means such as heat-shrink wrappings or by wrapping using a tape, this latter technique being known as "strapping". In fact, there is an increasing demand to minimize the time necessary for the loading and strapping of these pallets, when this technique is implemented, while at the same time increasing their capacity for resisting the various shocks which they may be subjected to during the transport and various handling operations which they undergo.

As regards minimizing the loading times, palletization robots are already known which automatically position the articles to be loaded from a conveyor, while memorizing the various positions which may be filled on the pallet, and the level of the loading taking place.

In addition, in order to provide a greater cohesion for the loads palletized in this way, it is known, particularly with bags of bulk materials for example, to partially coat these bags by means of a socalled "palletization" glue, having the property of not drying completely, thus enabling the articles of intermediate levels to be glued together. Nevertheless, this placing of glue does not prove to be satisfactory, since it generally turns out to be difficult to get rid of all the glue, and as a result of this, it causes dirtiness.

It has then been proposed to insert intermediate sheets made of cardboard or plastic between the various palletization levels. Even though these sheets provide the general cohesion of the load of the articles of a same layer or of a same level of palletization, they do not prevent, on the other hand, the slipping of a complete layer relative to the preceding or following layer and it is only after placing of the stretchable plastic film for strapping or of the heat-shrink wrapping that the cohesion of the assembly of the primary packagings on the pallet is obtained.

Even though these solutions are satisfactory as regards technique and automation, they have the crippling disadvantage of using plastic films which are not naturally degradable, and which therefore cause pollution.

Consequently, one object of the invention is to propose a method for packaging a palletizable load which, on the one hand, avoids the disadvantages inherent in plastic films implemented in the known techniques, while on the other hand, providing an excellent cohesion of the palletized loads.

SUMMARY OF THE INVENTION

The method for packaging a palletizable load, in which the constituent elements of the load are positioned on the pallet in several levels or layers of palletization by means of a so-called "palletization robot", is characterized according to the invention in that:

a sheet of a material having non-slip properties is inserted between each level of palletization; and the peripheral strapping of the load is carried out by means of a stretchable paper tape.

In other words, the invention consists in increasing the cohesion of the palletized loads by inserting a sheet of material, which is capable of maintaining the cohesion, on the one hand, between the various elements of a same palletization level, and on the other hand, between two consecutive palletization levels, while at the same time substituting the stretchable or heat-shrinkable plastic film of the known technique with a stretchable paper tape, particularly lengthwise, thus avoiding all the crippling disadvantages relating to plastic films.

In certain cases, it is possible to only use one tape of non-slip material which does not cover the whole width of the pallet, as an intermediate sheet between two palletization levels. In other applications, the non-slip material implemented between two palletization levels is in the form of two parallel or crosswise tapes, or a vast number of tapes without necessarily completely covering the pallet surface.

The invention also relates to an installation for the implementation of the method as just defined. This installation, comprising a palletization device, intended to position the constituent elements of the load on a pallet from a conveyor, and a device for delivering, guiding and positioning a stretchable paper tape onto the said load for strapping the load over its whole height, is characterized in that it furthermore includes :

a portal, which is capable of unrolling at least one tape of a non-slip material above each of the levels of palletization and of cutting a predetermined length of the said material; as well as means of applying the paper tape on the load after pasting of the said stretchable paper tape, which tape is cut at the end of the strapping operation.

According to one advantageous embodiment of the invention, the stretchable paper tape is a microcreped paper tape, which is pasted by a member which is solidly fixed to the device for delivering, guiding and positioning the paper tape.

The deposit of adhesive by the pasting member may only be carried out on the part of the paper tape which is intended to be immediately covered by the following tape winding.

In certain cases, stretching means may be provided, intended to stretch the microcreped paper tape by a predeterminable value, the said means being located upstream of the device for delivering, guiding and positioning the paper tape.

The said stretching means consist advantageously of a set of rollers around which the microcreped paper tape is sent back, the said rollers rotating with different tangential speeds.

The adhesive is a glue deposited on the external surface of the paper tape, prior to its positioning on the palletized load.

According to one embodiment of the invention, the installation is of the type having a rotary horizontal plate which is suitable for receiving the pallet and the load, while the device for delivering, guiding and positioning the stretchable paper tape is mounted in translation substantially perpendicularly to the said plate, the latter being fitted with a clip for recuperating the paper tape, which clip is intended to take hold of the said tape when it has been cut at the end of the strapping operation of the preceding pallet, and in order to enable the placing of the said tape on the following pallet, the said clip being solidly fixed to the rotary plate and being retractable below the plane defined by the latter.

The portal intended to enable the placing of the non-slip material, and which advantageously is also paper, comprises two horizontal arms which are mounted as cantilevers and at the level of which are mounted two rollers, one being motive and the other pressing, intended to reel off the tape of non-slip material, at the same time as the progressing of the two arms at the level of the portal.

BRIEF DESCRIPTION OF THE DRAWINGS

The way in which the invention may be implemented and the advantages resulting therefrom will be revealed more clearly by the embodiment which follows, given by way of information and in a non-limiting manner, supporting the attached figures.

DETAILED DESCRIPTION

Figure 1:
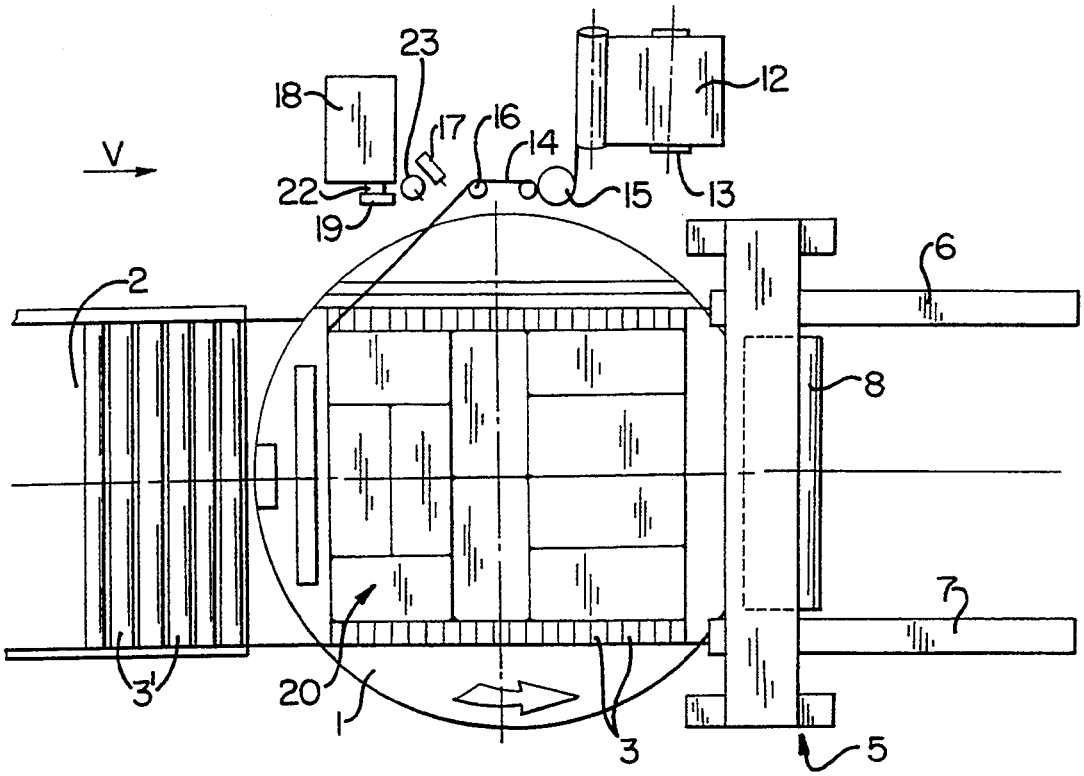
FIG. 1 shows a simplified diagrammatical plan view of an installation in accordance with the invention.
Figure 2:
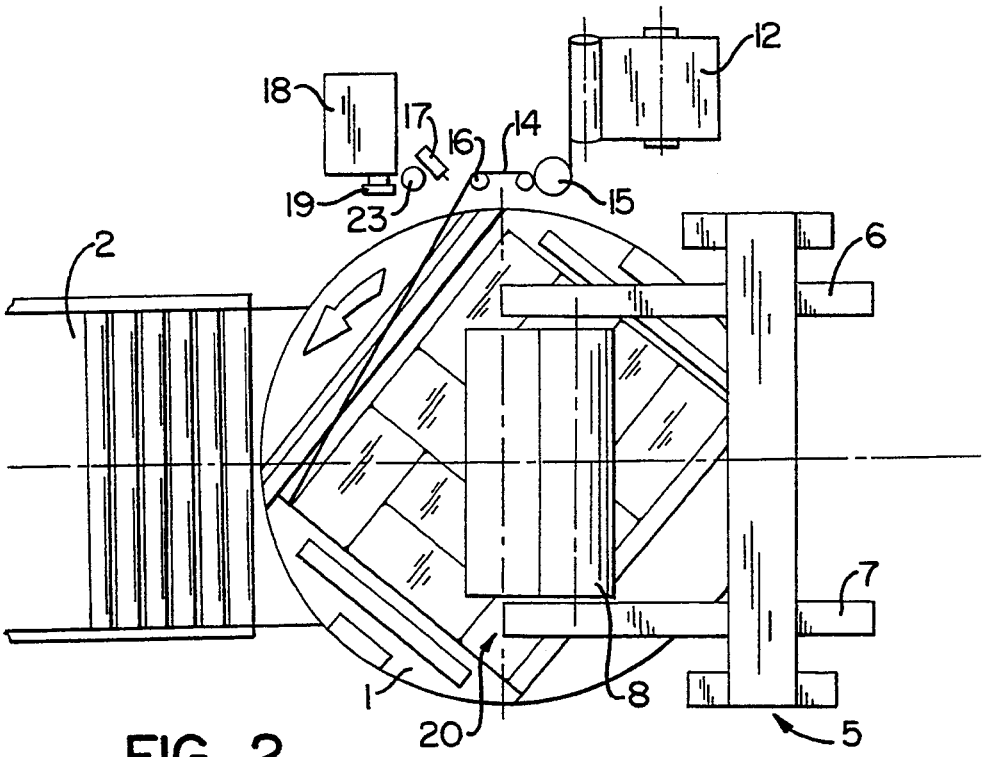
FIG. 2 shows another diagrammatical plan view of the installation in accordance with the invention.
Figure 3:
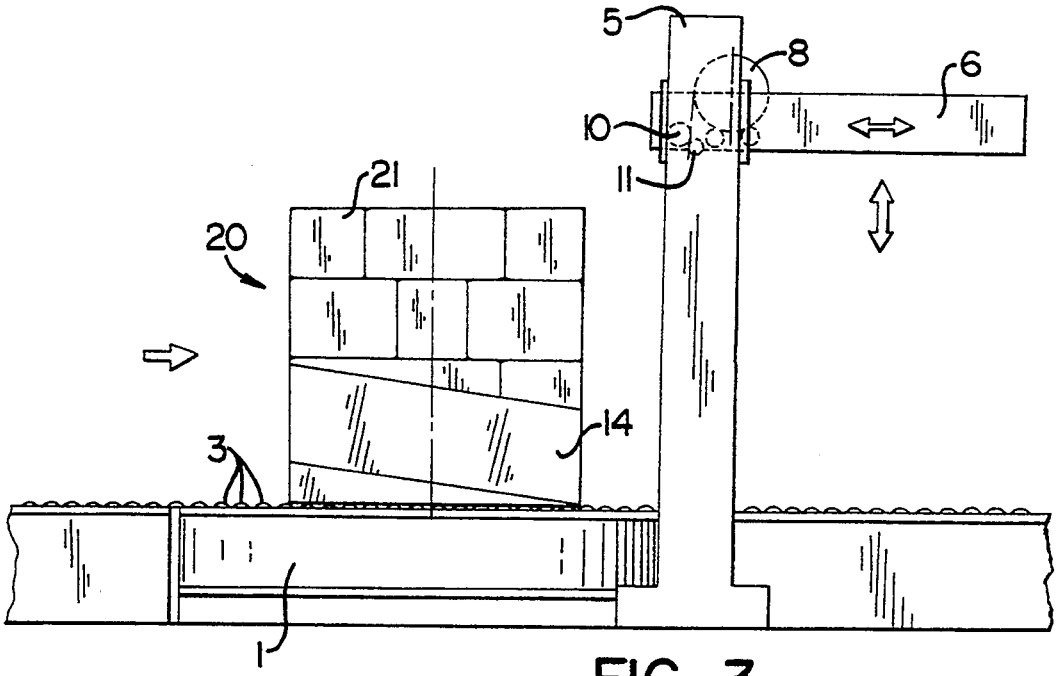
FIG. 3 shows a diagrammatical side elevation of this installation.
Figure 4:
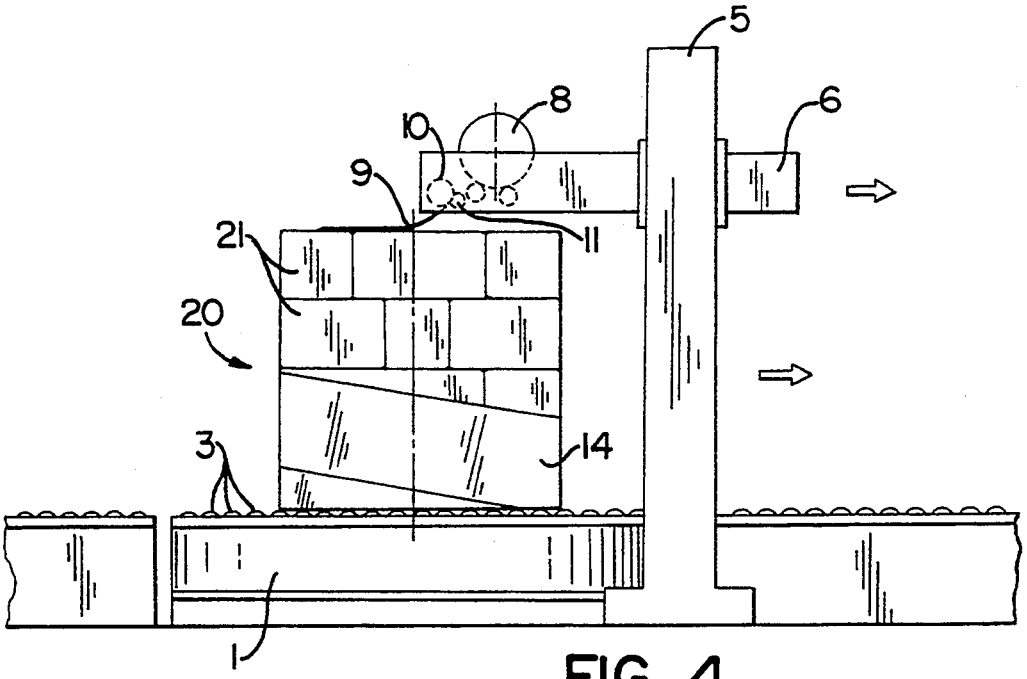
FIG. 4 shows another side elevation of the installation during another phase of operation.

An installation for implementing the method in accordance with the invention will now be described in detail. This installation for packaging a palletizable load includes a work station to the region of which a rigid pallet is conveyed. This station comprises a horizontal plate 1 which is circular and rotary relative to its central axis, the rotation of this plate being ensured by means of a motor, not shown, typically at a speed around 15 revolutions/minute. This plate 1 comprises over a large part of its upper surface, parallel rotary rollers 3 intended to enable, on the one hand, the positioning of the pallet on the plate from an entry route 2 (such as a conveyor having rotary rollers 3'), and on the other hand, the removal of the loaded pallet towards the following station, not shown, typically towards the station for shipping and despatching the pallet thus loaded.

This work station comprises a palletization station which is advantageously automatic but which could be manual in certain embodiments of the invention. Since it is known to use so-called "palletization" robots which position and memorize the position of the constituent elements of a load at the level of each of the palletization levels, from a conveyor routing the said elements, there is no need to describe such a robot here in more detail.

According to the invention, the installation further comprises a portal, given the general reference 5, which is placed near the plate 1 and which carries two horizontal arms, mounted as cantilevers 6 and 7 respectively. A reel 8 of a material 9 which has non-slip properties on one of its faces, or advantageously on both its faces and which is advantageously paper, is mounted loose in rotation between these two arms. As will be described in more detail below, this non-slip paper is intended to provide the palletized load assembly with a greater cohesion and correlatively with a greater resistance to the various shocks to which it may be subjected, particularly during its transport.

Two rollers 10 and 11 respectively, one being motive and the other pressing, are also mounted between the two arms 6 and 7 of the portal 5, the two rollers being parallel to the reel 8 and in contact with each other.

The two arms 6 and 7 of the portal 5 are capable of moving simultaneously, on the one hand vertically, and on the other hand, horizontally. The operation of the portal will also be described in more detail below.

According to another characteristic of the invention, the installation comprises a station or device for delivering a tape of stretchable paper, and particularly of microcreped paper. This station, also located near the rotary central plate 1, includes a horizontal reel 12 of the said microcreped paper having a diameter which may easily reach and even exceed one metre, thus enabling the automatic installation in accordance with the invention to be more independent.

Because of the relatively sizable weight of this reel, the roller 13, on which the reel is mounted, is motorized, in order to ensure that the paper tape is delivered evenly. This paper tape 14 is firstly recuperated by a set of unreeling rollers (not shown), then is sent back by means of a roller (also not shown) which is inclined towards a vertical plane at the level of the paper stretching means 15, the said means consisting typically of a plurality of vertical rotary rollers having different tangential speeds, in order to produce between them a stretching of the creped or microcreped paper by an amount between 50 and 100%, or possibly more, of its initial length.

It shall be noted that the stretching means 15 are not necessarily present insofar as the paper tape 14 may be stretched in an installation in accordance with the invention by the simple rotation of the load 20, which, because of the braking undergone by the tape, inherent in the inertia of the various return rollers, causes the tape 14 to extend and even to adapt locally to the possible roughness of the load.

By using creped paper, a local stretching is obtained which adapts closely to the periphery of the load 20 to be strapped.

The tape 14, which may or may not have been prestretched by the means 15, is picked up by a delivering device symbolized by a roller 16 which is capable of moving vertically in translation, and this is achieved by any suitable means, particularly by a jack, in order to ensure that the palletized load is strapped peripherally over its whole height.

According to the invention, the delivering device 16 is advantageously combined with a pasting member 17, typically consisting of a gun and which moves vertically in translation with the delivering device 16 in order to deposit spots of glue 4 on the external face of the tape 14 to be positioned on the load 20.

Figure 5:
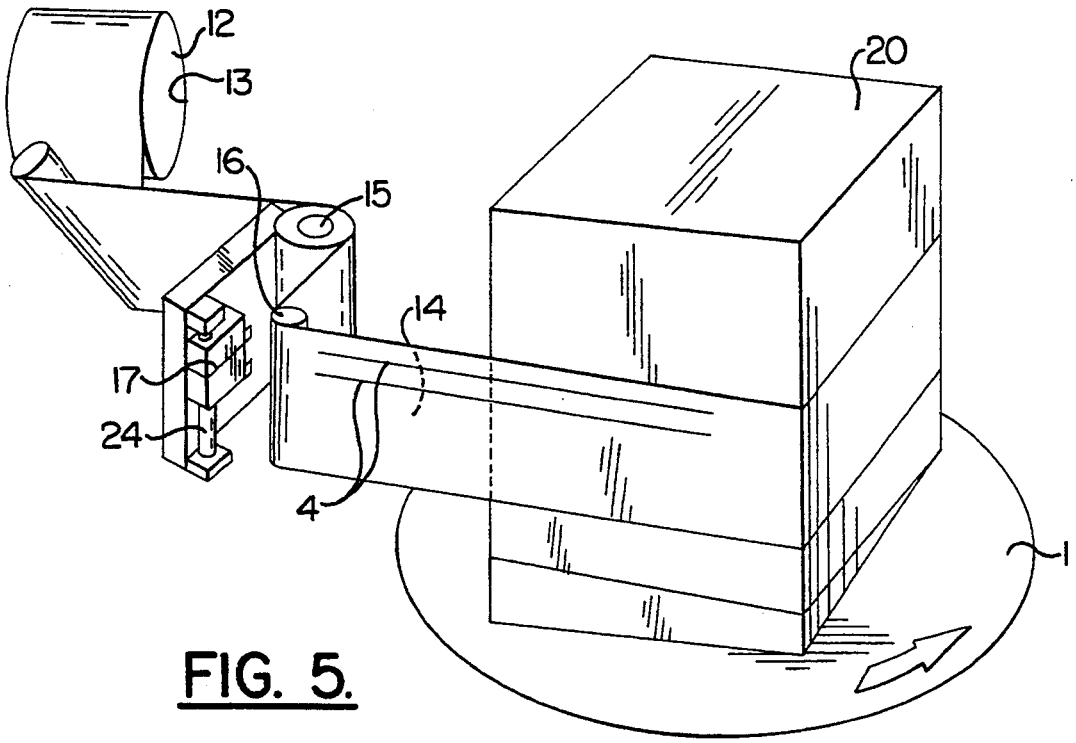
FIGS. 5, 6, 7 and 8 are diagrammatical representations of the operation of the installation in accordance with the invention, looking along the direction of the arrow V in FIG. 1.
Figure 6:
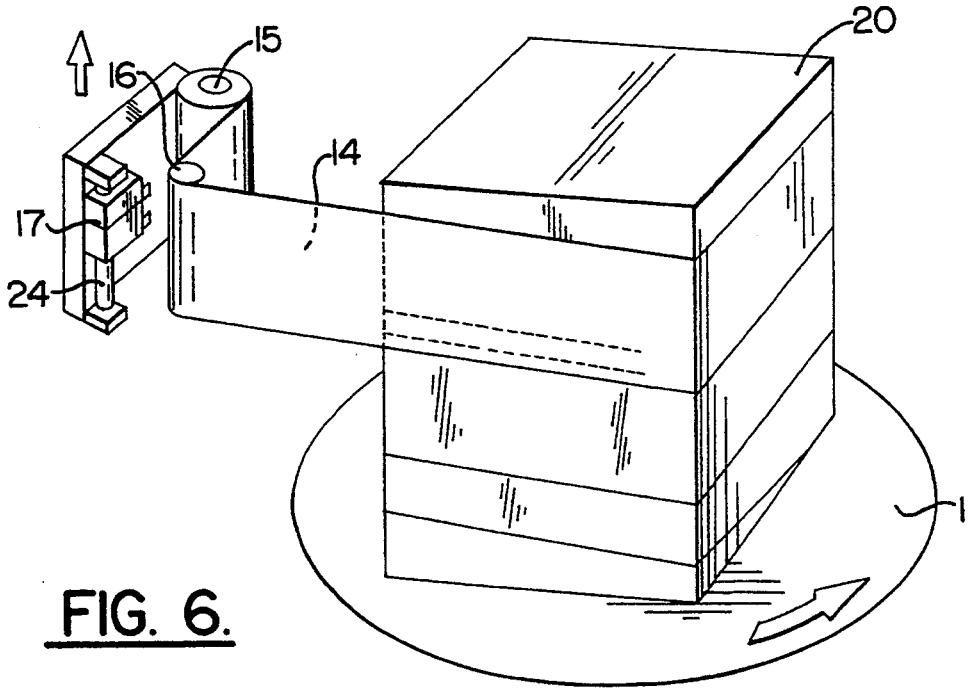
Figure 7:
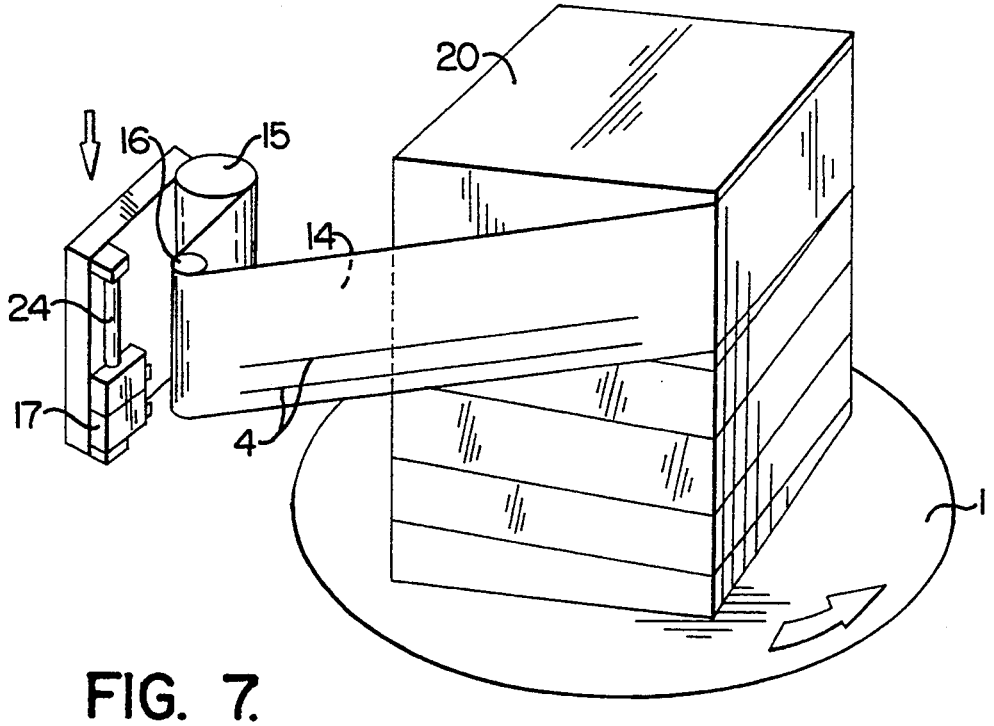
Figure 8:
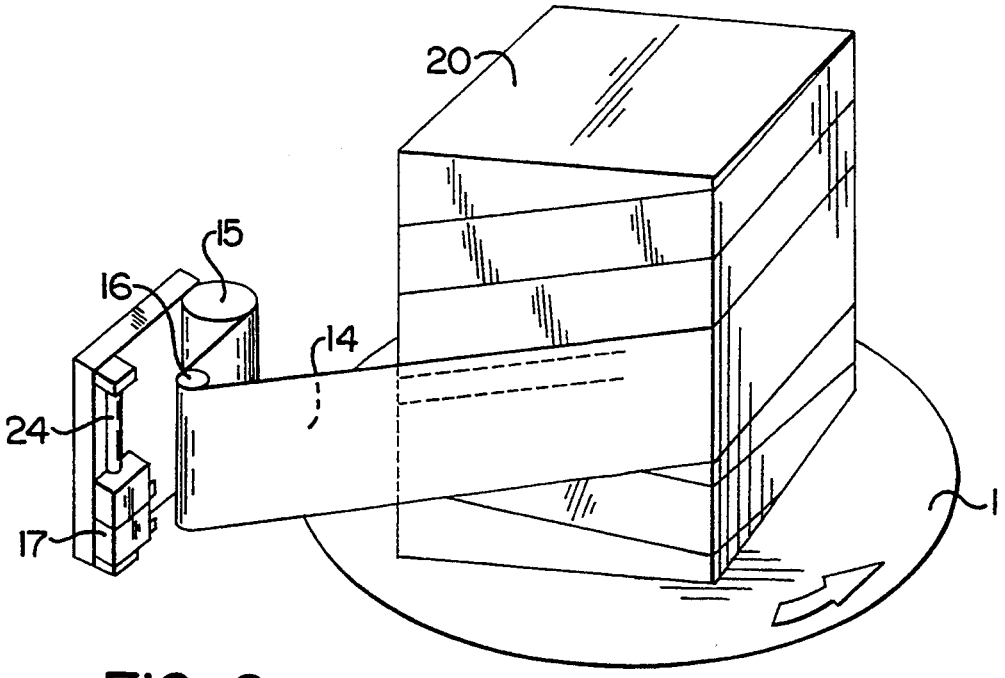

According to an advantageous embodiment of the invention, this member 17 only delivers spots of glue at the upper part of the said tape 14, when the delivering device 16 is in the phase of ascent, and only in the lower part of this same external face when the delivering device 16 is in the phase of descent. In order to achieve this, the pasting member 17 may move advantageously on a guide-rod 24 which is solidly fixed to the delivering device 16, for example under the action of a jack (not shown) which is also solidly fixed to the delivering device. The said jack causes the pasting member 17 to be placed at the upper part of the travel of the guide-rod 24 during the phase of ascent of the strapping, and at the lower part of this same travel during the phase of descent, as has been moreover shown in FIGS. 5 to 8. In this way, the tape which is being laid only covers the pasted part of the preceding tape, and in addition, no spot of glue remains uncovered, this being in order to diminish, or even possibly eliminate, any risk of inopportune gluing, but also to reduce the dirtiness caused by the glue. The superposition of one tape over the next is thus observed creating, in this way, overlapping areas, in the region of which the spots of glue 4 are placed.

Thus, in the event of sudden ill-timed breaking of the tape, particularly at the upper region, the rest of the strapping is held in place in the region of the palletized load.

According to another characteristic of the invention, the installation also comprises an assembly for fixing and positioning the stretched paper tape, consisting of a block 18 which is mobile in horizontal translation, and which is intended to approach the load 20, particularly at the end of the strapping operation. This block 18 essentially includes a rubberized pad 19, which is itself driven by a piston 22, and which is intended to press the paper tape 14 at the end of the strapping operation onto the load when the paper is cut. This cutting is carried out by means of a blade which is integrated into a guide 23 which, at the end of the strapping operation, proceeds to the cutting of the tape which is being applied, the end which is then free of the tape originating from the delivering device 16 being simultaneously recuperated by a clip (not shown), as will be described below during the explanation of the operation of this installation.

When an empty pallet arrives onto the circular plate 1 via the entry route 2, the constituent elements 21 of the load 20 to be palletized are arranged manually or automatically in a first palletization level.

Once this level is full, the portal 5 is rendered operational and more precisely, the arms 6 and 7 position themselves at a height slightly above the said first palletization level, then the said arms move horizontally in translation, until the reel 8 reaches the external limit of the said first level.

The said arms 6, 7 then return to their initial horizontal position, that is to say retracted relative to the said load, and simultaneously, the motive roller 10 is activated in order to unreal a tape 9 of a non-slip paper over all or part of the surface of the said palletization level.

In fact, according to the invention and depending on the density or weight of the constituent elements of the palletized loads, it is possible to devise the positioning on each of the levels of a sheet covering the whole of the surface of the said level, or even of one tape placed lengthwise, widthwise or possibly even diagonally on the level without covering its total surface, or even of two tapes placed lengthwise, widthwise or diagonally and possibly of tapes placed cross-wise. In this way, it is thus possible to save on non-slip paper.

In fact, depending on the choice of the user, the portal 5 is activated a certain number of times for a same level, the orientation of the said tape on the said palletization level being obtained by simply rotating the circular plate 1.

This operation is repeated several times, according to the number of levels, until the total load 20 is completed. The actual strapping of the load palletized in this way is then carried out.

The FIGS. 5 to 8 show the various phases of strapping by means of the installation in accordance with the invention.

During the first rotations, the tape 14 is recuperated by means of a clip (not shown), which is solidly fixed to the rotary plate and which is retractable below the plane of the latter.

Once the first winding or windings have been carried out, this clip is retracted, the said tapes being held by simple traction.

Correlatively, the delivering member 16 undergoes a phase of ascent (FIG. 6), while at the same time producing an overlapping of one tape over the other, and a prepasting of the external surface of the preceding tape in the upper area, in order to paste only the smallest area possible of the said tape.

Once the phase of ascent is completed, the phase of descent takes place in the same way, the said tape still undergoing a prepasting. At the end of the strapping operation, the already mentioned clip takes hold of the tape, and correlatively, the fixing and positioning assembly 18 presses against the last tape and cuts the latter in line with the clip.

The tape cut in this way is applied by the rubberized pad 19 against the load, the free end of the other tape being recuperated by the clip and ready for strapping another load.

The load strapped in this way may be removed towards the shipping area.

This installation has many advantages, taking account of, on the one hand, the use of paper which is naturally degradable for the strapping, and on the other hand, the insertion of non-slip paper which provides the said loads palletized and packaged in this way with the cohesion which the means known today could not provide.

In addition, it may be stated that the external prepasting prevents the load from ever being stained or glued. Moreover, because it is possible to store the paper reel horizontally, the automatic assembly being run by a programmable self-contained controller may be independent to a very large degree and as a result, requires appreciably fewer manoeuvers.

We claim:

1. An installation for packaging a palletized load formed of a plurality of constituent elements positioned in several layers of palletization, compromising means for providing at least one separator sheet of a non-slip material between each of the layers of palletization;

a device for delivering, guiding and positioning a stretchable paper tape onto the sides of the palletized load;

means mounting said tape delivering device for movement vertically in translation so that the tape is applied in successive tape windings over the entire height of the palletized load during ascent or descent of the tape delivering device;

a pasting member carried by said tape delivering device and operable for applying adhesive to the stretchable paper tape, means mounting said pasting member for movement vertically in translation relative to the tape delivering device between an upper position and a lower position during strapping of the load, said pasting member being positioned in the upper position during ascent of the tape delivering device and in the lower position during descent of said delivering device so that the adhesive which is applied by the pasting member is applied only to the part of the paper tape which is to be immediately covered by a successive tape winding; and means for cutting the stretchable paper tape at the end of the strapping operation.

2. Installation as claimed in claim 1, wherein the stretchable paper tape is a microcreped paper tape, the installation additionally comprising stretching means for stretching the microcreped paper tape by a predeterminable value, said stretching means being located upstream of the device for delivering, guiding and positioning the paper tape, and consisting of a brake comprising a set of rollers around which the microcreped paper tape is sent back, the said rollers rotating with different tangential speeds.

3. Installation as claimed in claim 1, wherein the adhesive is a glue deposited on an external surface of the stretchable paper tape prior to its positioning on the palletized load.

4. Installation as claimed in claim 1, including a rotary horizontal plate which is suitable for receiving the pallet and the load, and wherein said device for delivering, guiding and positioning the stretchable paper tape is mounted in translation substantially perpendicularly to the said plate.

5. Installation as claimed in claim 1, wherein said means for providing at least one separator sheet of a non-slip material between each of the layers of palletization comprises two horizontal arms which are mounted as cantilevers and on which are mounted two rollers, one being motive and the other pressing to reel off a reel of the separator sheets of non-slip material.

* * * * *

UNITED STATES PATENT AND TRADEMARK OFFICE

CERTIFICATE OF CORRECTION

PATENT NO. : 5,351,461

DATED : October 4, 1994

INVENTOR(S) : Philippe Fandard et al.

It is certified that error appears in the above-identified patent and that said Letters Patent is hereby corrected as shown below:

On title page, item [75], the city of inventor "Philippe Fandard" listed as "Lyons", should be -- Lyon --.

Column 6, line 49, "compromising" should be -- comprising --.

Signed and Sealed this

Twenty-ninth Day of November, 1994

Bruce Lehman

*Attest:*

BRUCE LEHMAN

*Attesting Officer*

*Commissioner of Patents and Trademarks*